US012607176B2

(12) United States Patent
Li et al.

(10) Patent No.: US 12,607,176 B2
(45) Date of Patent: Apr. 21, 2026

(54) MAGNETIC FLUID MICROPUMP

(71) Applicants: XIHUA UNIVERSITY, Chengdu (CN); QINGHAI INSTITUTE OF TECHNOLOGY, Xining (CN)

(72) Inventors: Zhenggui Li, Chengdu (CN); Ye Wang, Chengdu (CN); Xing Zhou, Chengdu (CN); Decai Li, Chengdu (CN)

(73) Assignees: XIHUA UNIVERSITY, Chengdu (CN); QINGHAI INSTITUTE OF TECHNOLOGY, Xining (CN)

( * ) Notice: Subject to any disclaimer, the term of this patent is extended or adjusted under 35 U.S.C. 154(b) by 0 days.

(21) Appl. No.: 19/023,674

(22) Filed: Jan. 16, 2025

(65) Prior Publication Data

US 2025/0389262 A1 Dec. 25, 2025

(30) Foreign Application Priority Data

Jun. 19, 2024 (CN) ..... 202410790726.3

(51) Int. Cl.

| | |
|---|---|
| ***F04B 19/00*** | (2006.01) |
| ***F04B 19/04*** | (2006.01) |
| ***F04B 19/22*** | (2006.01) |
| ***F04B 37/10*** | (2006.01) |

(52) U.S. Cl.

CPC ..... *F04B 19/006* (2013.01); *F04B 19/04* (2013.01); *F04B 19/22* (2013.01); *F04B 37/10* (2013.01)

(58) Field of Classification Search

CPC ..... F04B 19/006; F04B 19/04; F04B 19/22; F04B 37/10

See application file for complete search history.

(56) References Cited

U.S. PATENT DOCUMENTS

2016/0319806 A1* 11/2016 Ashouri ..... F04B 53/14

FOREIGN PATENT DOCUMENTS

KR 100717294 B1 * 5/2007

OTHER PUBLICATIONS

English Translation KR100717294B1 (Year: 2007).*

* cited by examiner

*Primary Examiner* — Shafiq Mian

(74) *Attorney, Agent, or Firm* — Yue (Robert) Xu; Apex Attorneys at Law, LLP

(57) ABSTRACT

A magnetic fluid micropump includes an annular flow channel, a fixed magnetic assembly and a driving magnetic assembly. A magnetic fluid is provided inside the annular flow channel. The fixed magnetic assembly is arranged outside the annular flow channel in a stationary manner so that a part of the magnetic fluid is attracted and fixated in the annular flow channel to form a magnetic fluid valve. An inlet tube and an outlet tube that are in communication with the annular flow channel are respectively provided on both sides of the fixed magnetic assembly along a path of the annular flow channel. The driving magnetic assembly is arranged outside the annular flow channel and configured to move along the path of the annular flow channel, so that another part of the magnetic fluid moves along the annular flow channel to form a magnetic fluid piston.

8 Claims, 9 Drawing Sheets

MAGNETIC FLUID MICROPUMP

The present application claims the priority to Chinese Patent Application No. 202410790726.3, titled "MAGNETIC FLUID MICROPUMP", filed with the China National Intellectual Property Administration on Jun. 19, 2024, the entire disclosure of which is incorporated herein by reference.

FIELD

The present application relates to the technical field of micropumps, and in particular to a magnetic fluid micropump.

BACKGROUND

With the rapid development of life sciences, biomedicine, aerospace, micro-electro-mechanical engineering, etc., more and more microfluidic systems are required. Systems such as microfluidic chemical analysis systems, artificial blood pumps for treating myocardial infarction, micro drug injection systems, and micro fuel supply devices for spacecraft all require the microfluidic technology to develop towards high precision, high pumping stability, high pressure resistance, wide flow rate range, and high integrability.

As the executive elements of the microfluidic systems, micropumps play a role in the precise transmission and rapid control of microfluids, and are known as the "heart" of the microfluidic systems. Currently, the driving manners of the micropumps mainly include mechanical manners such as piezoelectric, electrostatic, electromagnetic, and pneumatic types, as well as non-mechanical manners such as electroosmotic, thermobubble-based, and magnet fluid based types. Among these mechanical and non-mechanical manners, the magnetic fluid driving manner has advantages of simple structure, high integrability, high pumping reliability, simple motion control, zero friction, self-sealing, self-repairing, and a long service life, and is increasingly becoming the main developing direction of micropumps.

An existing magnetic fluid micropump still has some drawbacks, such as low driving force.

SUMMARY

To solve the above technical problem, a magnetic fluid micropump is disclosed in the present application, which can improve a response speed of a magnetic fluid to a magnetic field and magnetization capability of the magnetic field on the magnetic fluid, thereby increasing a pushing force applied on the magnetic fluid.

The specific technical solutions of the present application are as follows.

A magnetic fluid micropump includes:

an annular flow channel in which a magnetic fluid is provided;

a fixed magnetic assembly, which is arranged outside the annular flow channel in a stationary manner so that a part of the magnetic fluid is attracted and fixated in the annular flow channel to form a magnetic fluid valve, and an inlet tube and an outlet tube, which are in communication with the annular flow channel, are respectively provided on both sides of the fixed magnetic assembly along a path of the annular flow channel; and a driving magnetic assembly, which is arranged outside the annular flow channel and are configured to move along the path of the annular flow channel so that another part of the magnetic fluid moves along the annular flow channel to form a magnetic fluid piston, the driving magnetic assembly include a first magnet and a second magnet that are respectively located on both sides of a plane in which the annular flow channel is located.

In the present application, the first magnet and the second magnet are respectively located on the both sides of the plane, in which the annular flow channel is located, to enhance the magnetic field strength, instead of being simply stacked on the same side. The reason lies in that, the propagation of the magnetic field highly depends on the distance. If the driving magnetic assembly is arranged on the same side of the annular flow channel, then the magnetic fluid is subjected to an increased coupling magnetic force on one side close to the driving magnetic assembly, and a decreased coupling magnetic force on the other side away from the driving magnetic assembly. As a result, the coupling applied on the magnetic fluid in the annular flow channel is unbalanced, and therefore, the magnetic fluid may leak on either side at high rotational speeds or under high back pressures, causing failure of sealing of the magnetic fluid piston, which decreases the pumping capability. That is to say, due to the limitation of the propagation of the magnetic field, a sufficient and balanced coupling magnetic force can only be ensured if the first magnet and the second magnet are respectively arranged on the both sides of the microchannel. In other words, the first magnet and the second magnet are respectively located on the both sides of the plane, in which the annular flow channel is located, to enhance the magnetic field strength, instead of simple superposition of the first magnet and the second magnet. Based on the drawbacks of the conventional technology, the present solution not only ensures a sufficient coupling magnetic force applied on the magnetic fluid piston, but also makes the force balanced. As such, it is possible to avoid a viscous effect of the magnetic fluid at the microscale, which may otherwise cause high motion resistance of the magnetic fluid piston during the operation of the micropump. Therefore, it is possible to prevent jamming, low pumping flow rate, and even pumping failure due to lagging motions of the magnetic fluid piston.

Preferably, when the magnetic fluid piston and the magnetic fluid valve do not merge with each other, the magnetic fluid valve partially blocks the inlet tube and/or the outlet tube; and when the magnetic fluid piston and the magnetic fluid valve merge with each other, the magnetic fluid blocks the inlet tube and/or the outlet tube.

During the movement of the driving magnetic assembly, a small part of the magnetic fluid valve is located in the inlet tube and/or the outlet tube to partially block the inlet tube and/or the outlet tube. This part of the magnetic fluid valve can hardly reduce the pulsations of an inlet speed and/or an outlet speed. From the view of the outlet tube, the pulsation of the outlet speed of the micropump occurs when the driving magnetic assembly approach and then be gradually separated from the fixed magnetic assembly. During this process, the magnetic fluid piston and the magnetic fluid valve gradually merge with each other, and are then gradually separated from each other. During the merging of the magnetic fluid piston and the magnetic fluid valve, if the inlet tube and the outlet tube are far from each other, even the merged magnetic fluid cannot block the outlet tube completely. At this time, there is an outlet back pressure at the outlet tube, which may drive a pumped liquid to flow back, leading to a significant pumping fluctuation. In this case, directly reducing a cross sectional diameter of the outlet tube may cause the increase of the flow resistance of the pumped liquid. Furthermore, an excessively small cross sectional diameter of the outlet tube may lead to an excessively small reserved space for the magnetic fluid, making the magnetic fluid be extruded from the tube during merging. Hence, the possibility of the backflow can be effectively reduced by partially blocking the outlet tube. Furthermore, the outlet tube is blocked by the merged magnetic fluid during the merging of the magnetic fluid, which can better prevent the backflow caused by the outlet back pressure. It may be known that, there may be a back pressure at the inlet tube as well to cause backflow, the principle of which is similar to that of the backflow at the outlet tube described hereinabove.

Preferably, the first magnet and the second magnet are arranged eccentrically on a moving path of the magnetic fluid piston.

When there is an eccentricity angle between the first magnet and the second magnet of the driving magnetic assembly, a gradient of the magnetic field strength at a position of the magnetic fluid in the annular flow channel can be increased. Moreover, an appropriate offset between the first magnet and the second magnet can decrease the peak amplitudes of the entire distribution of the traveling waves of the magnetic field and expand high-magnetic-flux-density areas in the magnetic field, thereby reducing the degree of extremity of the movement of the magnetic field and enhancing the uniformity. This change in the magnetic field further allows the magnetic fluid in the annular flow channel to suffer a strong coupling magnetic force while having higher stability.

Preferably, the eccentricity angle between the first magnet and the second magnet ranges from 1° to 9°.

With the eccentricity angle ranging from 1° to 9°, the driving magnetic assembly has a better driving performance.

Preferably, each of the inlet tube and the outlet tube expands along a direction from the inside to the outside of the annular flow channel.

With the expanding structure, a diameter of each tube gradually increases to reduce the flow resistance as well as provide sufficient spaces for the magnetic fluid to prevent the magnetic fluid from being extruded from the tube.

Preferably, during a movement of the magnetic fluid piston along the annular flow channel, an outer edge of the magnetic fluid valve, which partially blocks the inlet tube and the outlet tube, is of an arc shape.

Based on a position where the fixed magnetic assembly is arranged, the outer edge of the attracted magnetic fluid valve forms an arc shape. By taking the advantage of the characteristics of the magnetic field, this structure can partially block the inlet tube and/or the outlet tube well. Hence, the backflow is effectively suppressed, thereby effectively reducing the speed pulsations at the inlet tube and/or the outlet tube.

Preferably, each of the inlet tube and the outlet tube extends outwards along a radial direction of the annular flow channel, and the fixed magnetic assembly is arranged on an outer side of the annular flow channel along the radial direction.

This structure has good stability, and the driving magnetic assembly can be well arranged to avoid movement interference and high space occupancy.

Preferably, a length of a first arc of the annular flow channel, where the magnetic fluid valve is attracted, is smaller than a length of a second arc of the annular flow channel where the magnetic fluid piston moves.

The arc lengths of different regions in the annular flow channel are related to the pumping capacity of the micropump. On the basis of satisfying the pumping requirement and preventing the backflow, the pumping flow rate can be effectively improved by extending the moving distance of the magnetic fluid piston in the annular flow channel.

Preferably, magnetic poles of the first magnet are oriented in a same direction as magnetic poles of the second magnet.

The magnetic poles of the first magnet and the second magnet are oriented in the same direction, which penetrates through the annular flow channel and the magnetic fluid. In this way, it is possible to enhance the magnetic field gradient and enlarge an effective magnetic field interference zone in the micropump, so that the magnetic fluid exhibits better magnetization capability and self-sealing performance in the superposed magnetic field formed by coupling.

Preferably, a direction of magnetic poles of the driving magnetic assembly is perpendicular to a plane of motion of the magnetic fluid piston, and is perpendicular to a direction of magnetic poles of the fixed magnetic assembly.

This structure is stable, and can better drive and stop the magnetic fluid through the magnetic field, thereby better meeting the pumping requirement of the micropump.

Compared with the conventional technology, according to the present application, the response speed of the magnetic fluid to the magnetic field and the magnetization capability of the magnetic field on the magnetic fluid are improved, thereby enhancing the pushing force applied on the magnetic fluid, so that the driving force of the micropump is effectively increased. According to the present application, it is possible to enhance the magnetic field gradient and enlarge the effective magnetic field interference zone in the micropump, so that the magnetic fluid has better magnetization capability and self-sealing performance in the superposed magnetic field formed by coupling. According to the present application, it is possible to increase the coupling magnetic force between the magnetic fluid and the magnetic assemblies in the annular flow channel, so that the magnetic fluid can overcome higher flow resistance, so as to achieve a higher pumping speed, thereby extending the range of the pumping flow rate. Additionally, according to the present application, the backflow can be well suppressed, and the speed pulsations at the inlet tube and the outlet tube can be effectively reduced.

REFERENCE NUMERALS

1 annular flow channel,
2 fixed magnetic assembly,
3 driving magnetic assembly,
4 magnetic fluid valve,
5 inlet tube,
6 outlet tube,
7 magnetic fluid piston,
8 first magnet,
9 second magnet,
10 rotary motor,
11 support.

DETAILED DESCRIPTION OF THE EMBODIMENTS

For those skilled in the art to better understand the technical solutions of the present application, the present application will be further described in detail in conjunction with specific embodiments hereinafter.

Figure 1:
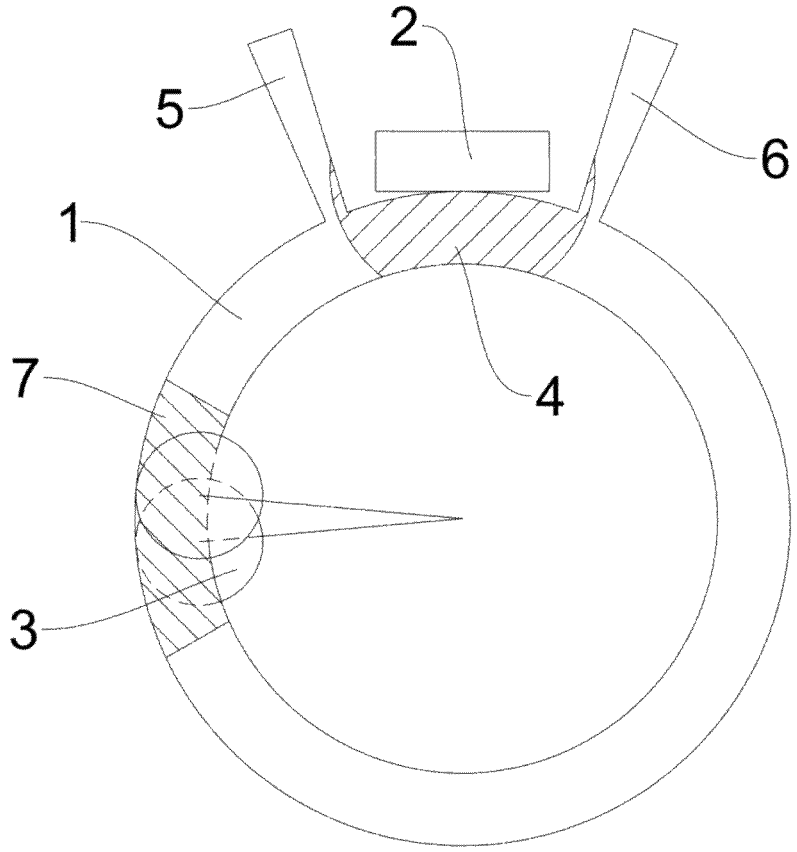
FIG. 1 is a schematic view of an embodiment of the present application where an inlet tube and an outlet tube of a magnetic fluid micropump are partially blocked.
Figure 2:
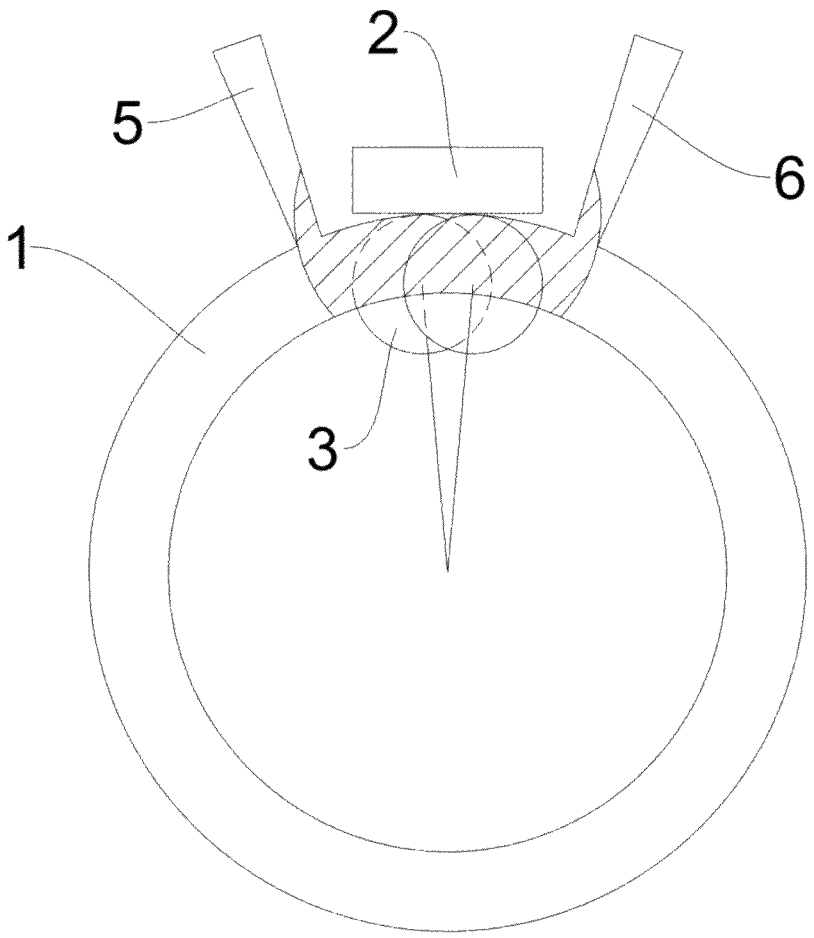
FIG. 2 is a schematic view of the embodiment of the present application where the inlet tube and the outlet tube of the magnetic fluid micropump are blocked.
Figure 3:
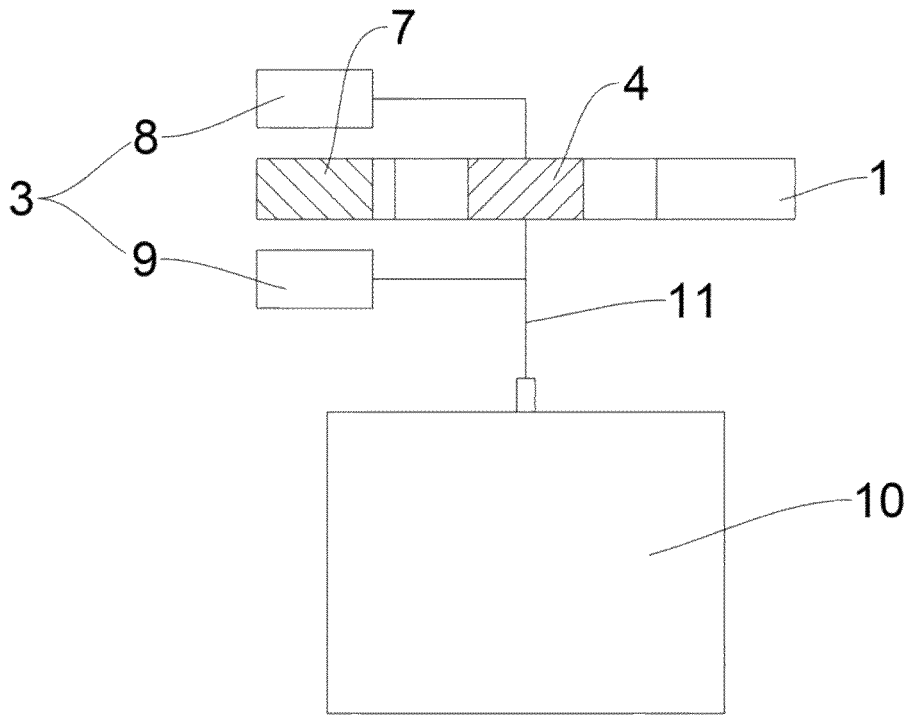
FIG. 3 is a side view of the magnetic fluid micropump in FIG. 1.

As shown in FIGS. 1 to 3, a magnetic fluid micropump includes an annular flow channel 1, a fixed magnetic assembly 2 and a driving magnetic assembly 3. A magnetic fluid is provided inside the annular flow channel 1. The fixed magnetic assembly 2 is arranged outside the annular flow channel 1 in a stationary manner, so that a part of the magnetic fluid is attracted and fixated in the annular flow channel 1, so as to form a magnetic fluid valve 4. Along a path of the annular flow channel 1, an inlet tube 5 in communication with the annular flow channel 1 is provided on one side of the fixed magnetic assembly 2, and an outlet tube 6 in communication with the annular flow channel 1 is provided on the other side of the fixed magnetic assembly 2. The driving magnetic assembly 3 is arranged outside the annular flow channel 1 and is configured to move along the path of the annular flow channel 1, so that another part of the magnetic fluid can move along the annular flow channel 1 to form a magnetic fluid piston 7. The driving magnetic assembly 3 includes a first magnet 8 and a second magnet 9 that are respectively located on both sides of a plane in which the annular flow channel 1 is located. Further, magnetic poles of the first magnet 8 are oriented in a same direction as magnetic poles of the second magnet 9.

In the present embodiment, the first magnet 8 and the second magnet 9 abut the annular flow channel 1 and are located above and below the annular flow channel 1, forming a double-driving magnetic coupling. In this way, based on the superposition of the magnetic fields, the magnetic field strength and the gradient of the magnetic field strength are increased, so as to make a magnetic force and a driving differential pressure force applied on the magnetic fluid both larger, thereby making the pushing force applied on the magnetic fluid increase. This superposition of the magnetic fields is not a simple addition. It is known that, the propagation of the magnetic field highly depends on the distance. If the first magnet 8 and the second magnet 9 are both arranged on a same side of the annular flow channel 1, then the magnetic fluid is subjected to an increased coupling magnetic force on one side close to the driving magnetic assembly 3, and a decreased coupling magnetic force on the other side away from the driving magnetic assembly 3. As a result, the coupling applied on the magnetic fluid in the annular flow channel 1 is unbalanced. Therefore, the magnetic fluid may leak on either side at high rotational speeds or under high back pressures, causing failure of sealing of the magnetic fluid piston, which decreases the pumping capacity. Such consequence mainly results from the limitation of the propagation of the magnetic field. Hence, a sufficient and balanced coupling magnetic force can only be ensured if the first magnet 8 and the second magnet 9 are respectively arranged on the both sides of the annular flow channel 1.

In the present embodiment, the magnetic fluid micropump further includes a rotary motor 10 and a support 11. The support 11 is connected to the first magnet 8 and the second magnet 9, and the first magnet 8 and the second magnet 9 are respectively located on the both sides of the annular flow channel 1. The rotary motor 10 is configured to drive the support 11 to move, so that the first magnet 8 and the second magnet 9 can move along the annular flow channel 1, thereby making the another part of the magnetic fluid move along the annular flow channel to form the magnetic fluid piston 7. During movement, the magnetic fluid piston 7 gradually moves towards the magnetic fluid valve 4, and thus decreasing the volume of a cavity between the magnetic fluid piston 7 and the magnetic fluid valve 4 and applying an extrusion force on the fluid in the cavity, thereby making the fluid flow out of the cavity through the outlet tube 6 and realizing the pumping process. During the merging and separation of the magnetic fluid piston 7 and the magnetic fluid valve 4, a part of the magnetic fluid is attracted at the inlet tube 5 and the outlet tube 6 to completely block the inlet tube 5 and the outlet tube 6, so as to block the backflow and reduce the outlet speed pulsation. When the next pumping cycle starts, under an external pressure gradient, an external fluid flows into the annular flow channel 1 through the inlet tube 5, filling a void in the annular flow channel 1. During this process, the first magnet 8 and the second magnet 9 improve the magnetic driving force, the self-sealing capability, and the effective magnetization area of the magnetic fluid. Therefore, it is possible to achieve higher pressure and higher pumping speed at the outlet tube 6, thereby solving the problems of low applicability and low reliability of the magnetic fluid micropump in the conventional technology.

In the present embodiment, the first magnet 8 and the second magnet 9 are separate structures. Alternatively, in other embodiments, the first magnet 8 and the second magnet 9 may be an integrated structure, such as a horseshoe magnet.

In the present embodiment, when the magnetic fluid piston 7 and the magnetic fluid valve 4 do not merge with each other, the magnetic fluid valve partially blocks the inlet tube 5 and/or the outlet tube 6. When the magnetic fluid piston 7 and the magnetic fluid valve 4 merge with each other, the magnetic fluid blocks the inlet tube 5 and/or the outlet tube 6. Specifically, in the present embodiment, during the movement of the magnetic fluid piston 7, the inlet tube 5 and the outlet tube 6 may be partially blocked by the magnetic fluid valve 4, and may be blocked by the magnetic fluid. Further, when the magnetic fluid piston 7 moves along the annular flow channel 1, an outer edge of the magnetic fluid valve 4, which partially blocks the inlet tube 5 and the outlet tube 6, is of an arc shape. Compared with the conventional technology, in the present embodiment, a distance between the inlet tube 5 and the outlet tube 6 is smaller. That is to say, a length of a first arc of the annular flow channel 1, where the magnetic fluid valve 4 is attracted, is smaller than a length of a second arc of the annular flow channel 1 where the magnetic fluid piston 7 moves. Hence, when the magnetic fluid piston 7 and the magnetic fluid valve 4 merges, a part of the magnetic fluid enters the inlet tube 5 and the outlet tube 6 to block them, thereby effectively prevent the backflow. When the driving magnetic assembly 3 approaches the fixed magnetic assembly 2, the magnetic fluid piston 7 and the magnetic fluid valve 4 gradually merge with each other. At this time, the part of the magnetic fluid enters the inlet tube 5 and the outlet tube 6 to effectively prevent the backflow. Otherwise, when the magnetic fluid piston 7 and the magnetic fluid valve 4 gradually merge with each other, the inlet tube 5 and the outlet tube 6 are not sealed by the magnetic fluid, and thus the outlet back pressure may force the pumped liquid at the outlet tube 6 to flow back. It may be noted that, when the magnetic fluid piston 7 and the magnetic fluid valve 4 gradually merge with each other, the magnetic fluid piston 7 do not push the pumped liquid in the annular flow channel 1 anymore, and the micropump is in a stage where it is unable to pump the pumped liquid. It may be known that, this stage is not caused by the inlet tube 5 and the outlet tube 6 being definitely sealed by the magnetic fluid, but is an unavoidable result of the merging of the magnetic fluid piston 7 and the magnetic fluid valve 4. Although the magnetic fluid cannot be pumped and delivered, the blocking of the inlet tube 5 and the outlet tube 6 by the magnetic fluid can effectively prevent the backflow caused by the back pressure at the outlet tube 6, and effectively reduce the speed pulsation at the outlet tube 6. It may be understood that, this principle can be applied to the inlet tube 5 as well, which is not described in detail herein.

To make better use of the present embodiment, the first magnet 8 and the second magnet 9 are arranged eccentrically along a moving path of the magnetic fluid piston 7. Further, an eccentricity angle between the first magnet 8 and the second magnet 9 ranges from 1° to 9°. As a preferred technical solution, a better performance can be achieved when the eccentricity angle between the first magnet 8 and the second magnet 9 ranges from 1.25° to 8.75°. During the operation of the micropump, the magnetic field excited by the moving driving magnetic assembly 3 is propagated in the form of traveling waves. In order to obtain the optimal eccentricity angle of the driving magnetic assembly 3, numerical analysis of the magnetic field is performed along a central measurement line of the annular flow channel 1 under different angles to obtain different traveling wave distributions of the magnetic field. Specifically, results of comprehensive evaluation of the self-sealing pressure based on average waveform factors, average peak factors and magnetic fluid mean field theory show that, the performance is optimal when the eccentricity angle of the driving magnetic assembly 3 is around 5°.

In the present embodiment, each of the inlet tube 5 and the outlet tube 6 expands in a direction from the inside to the outside of the annular flow channel 1. That is to say, an inner diameter of each of the inlet tube 5 and the outlet tube 6 gradually increases in the direction from the inside to the outside of the annular flow channel 1. When the pumped liquid flows through the inlet tube 5, there is a high flow resistance at the inlet tube 5, since the inner diameter of the inlet tube 5 gradually decreases. Therefore, when the driving magnetic assembly 3 drives the magnetic fluid piston 7 to move, the pumped liquid can be more stably pumped. When the pumped liquid flows through the outlet tube 6, the flow resistance decreases because the inner diameter of the outlet tube 6 gradually increases, so that the pumped liquid leaves the annular flow channel 1 rapidly. Hence, this structure well drives the pumped liquid to flow in a direction from the inlet tube 5 to the outlet tube 6.

In the present embodiment, each of the inlet tube 5 and the outlet tube 6 extends outwards along radial directions of the annular flow channel 1, and the fixed magnetic assembly 2 is arranged on an outer side of the annular flow channel 1 along a radial direction. This structure is simple and easy to dispose. Specifically, axial extension lines of the inlet tube 5 and the outlet tube 6 intersect at an inner side of the annular flow channel 1. The rotary motor 10 is connected to the driving magnetic assembly 3 from the inner side of the annular flow channel 1, so as to easily drive the driving magnetic assembly 3. To better form the magnetic fluid valve 4, the fixed magnetic assembly 2 is arranged on the outer side of the annular flow channel 1 and between the inlet tube 5 and the outlet tube 6. In this way, the fixed magnetic assembly 2 and the driving magnetic assembly 3 can pump the pumped liquid well. In other embodiments, in theory, axial extension lines of the inlet tube 5 and the outlet tube 6 may intersect at the outer side of the annular flow channel. In this case, the driving motor can only be connected to the driving magnetic assembly 3 from the outer side of the annular flow channel 1, making the structure relatively complicated. The fixed magnetic assembly 2 is located on the inner side of the annular flow channel 1. In this case, there is a relatively small space between the inlet tube 5 and the outlet tube 6 for assembly, which is not conductive to quick assembly of the fixed magnetic assembly 2. Therefore, the assembly process is also more complicated than the technical solutions of the present embodiment.

It should be noted that, in the present embodiment, directions of magnetic poles of the driving magnetic assembly 3 are perpendicular to a plane of motion of the magnetic fluid piston 7, and are perpendicular to a direction of magnetic poles of the fixed magnetic assembly 2. The direction of the magnetic poles described herein refers to a direction of the magnetic poles along an axis of the driving magnetic assembly 3. Therefore, in the present embodiment, an upper side face of the first magnet 8, an upper side face of the second magnet 9, and an upper side face of the annular flow channel 1 are parallel to each other. In this way, the utilization efficiency of the magnetic field can be maximized on the basis of the driving magnetic assembly 3 serving as the power output. Similarly, the upper side face of the fixed magnetic assembly 2 is perpendicular to the upper side face of the annular flow channel 1, which can also effectively maximize the utilization efficiency of the magnetic field.

In this way, when implementing the present embodiment, the rotary motor 10 is connected with the support 11, and the first magnet 8 and the second magnet 9 are fixed to the support 11. There is a certain eccentricity angle kept between the first magnet 8 and the second magnet 9. A direction of the magnetic poles of the first magnet 8 is the same as a direction of the magnetic poles of the second magnet 9, i.e., the North pole of the first magnet 8 and the South pole of the second magnet 9 correspond with each other to form the driving magnetic coupling. Certainly, it may be the South pole of the first magnet 8 and the North pole of the second magnet 9 that correspond with each other. As such, the rotary motor 10 drives the first magnet 8 and the second magnet 9 to move in uniform circular motions.

Influenced by the superposed magnetic field formed by the first magnet 8 and the second magnet 9, the magnetic fluid piston 7 exhibits magnetic response characteristics, and performs a uniform circular motion along with the first magnet 8 and the second magnet 9 under the action of the magnetic force. Under the action of the fixed magnetic assembly 2, the magnetic fluid valve 4 is adsorbed onto an inner wall of the annular flow channel 1 and remains stationary. In this way, the present embodiment can enhance the pumping capacity, the self-sealing performance and the stability of the magnetic fluid micropump, thereby greatly improving the applicability of the magnetic fluid micropump, so that the magnetic fluid micropump can be applied under operating conditions of high back resistance, high viscosity fluids delivery, wide flow rate range, etc.

Figure 4:
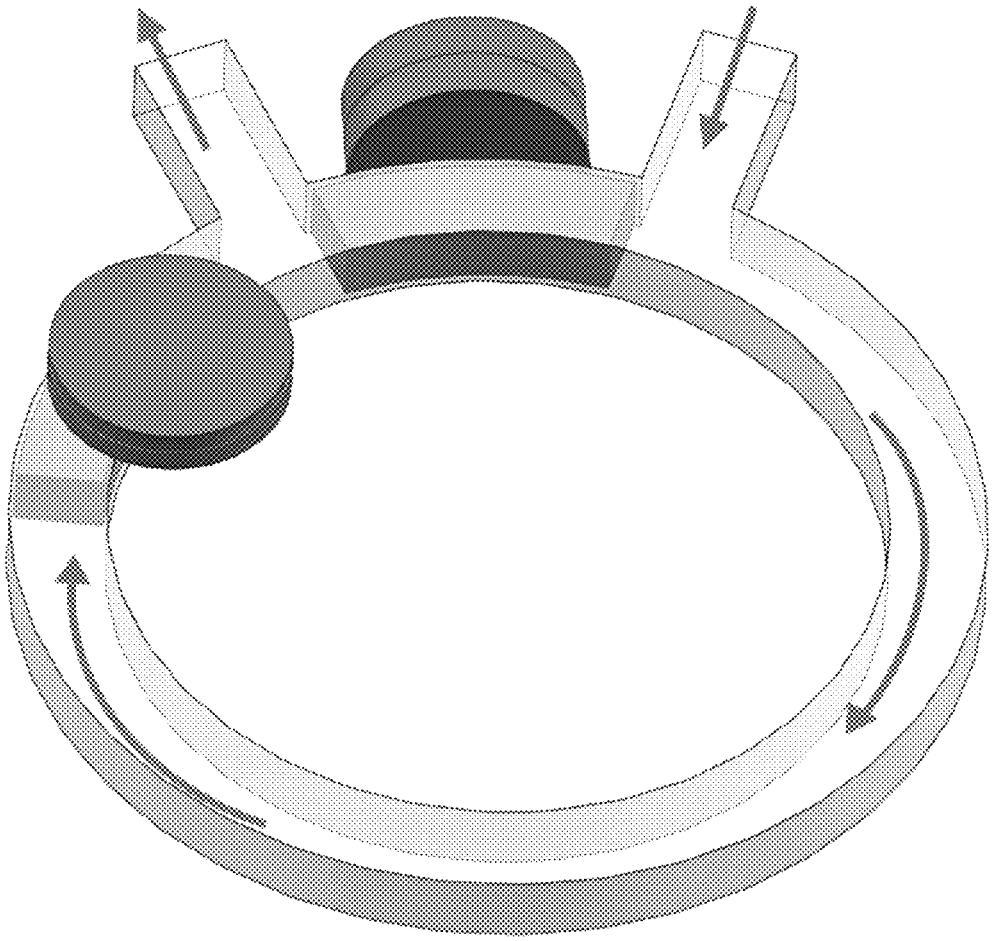
FIG. 4 is a schematic view of the conventional technology.
Figure 5:
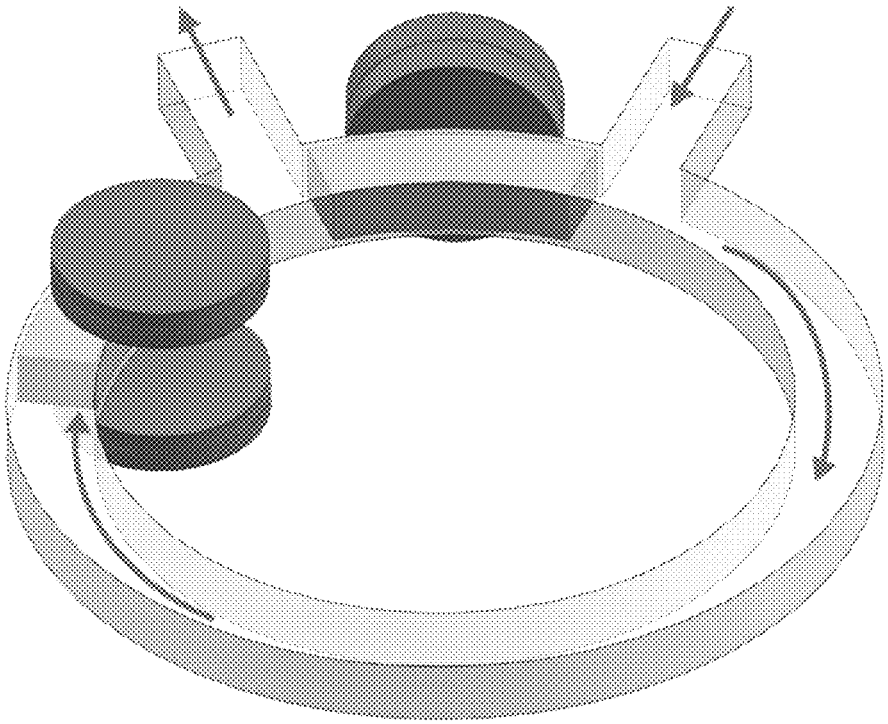
FIG. 5 is a schematic view of the embodiment of the present application.
Figure 6:
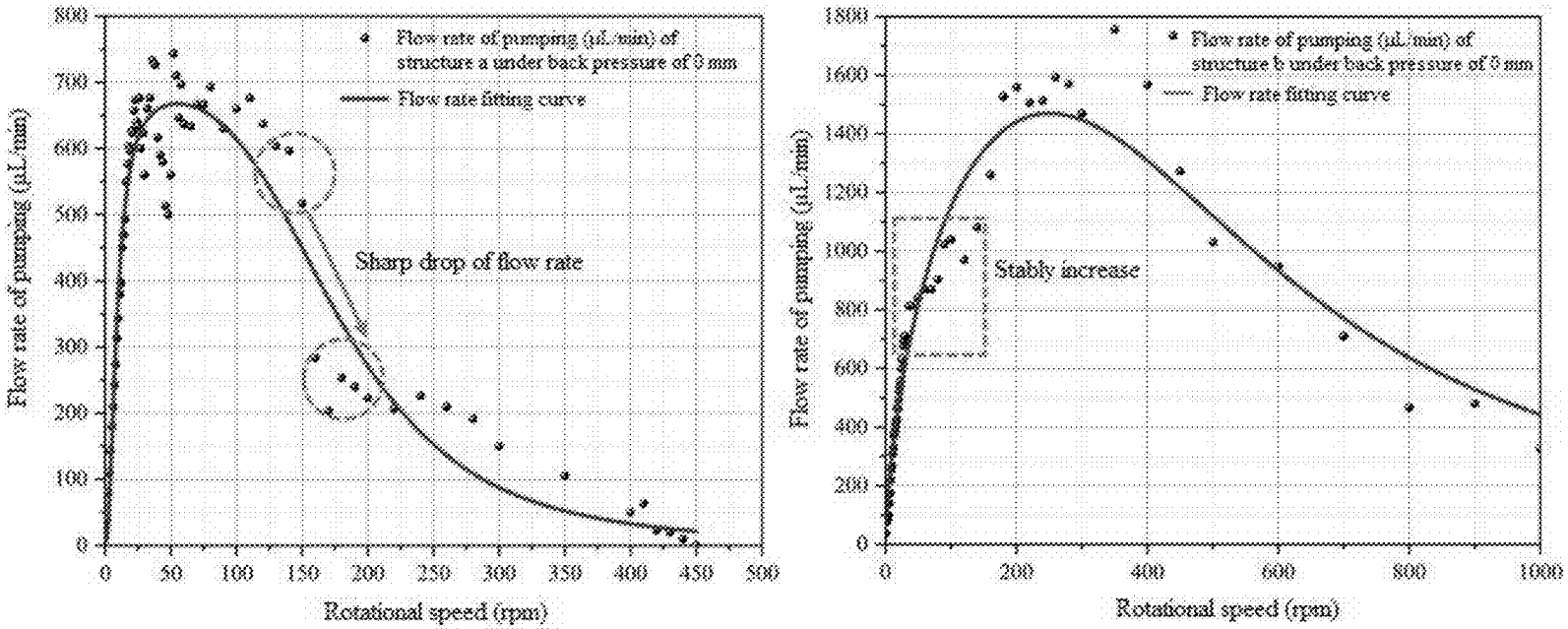
FIG. 6 shows comparison data graphs of the relationship between rotational speed and pumping flow rate for the conventional technology and the present embodiment under a back pressure of 0 mm of water column.

As shown in FIGS. 4 and 5, the micropump a is based on a solution of the conventional technology, and the micropump b is according to the technical solutions of the present embodiment. Arrows indicate a moving direction of the pumped liquid. When the pumping back pressure is 0 mm of water column, the micropumps achieve maximum pumping flow rates, and have maximum tolerable motor rotational speeds. As shown in FIG. 6, the micropump a has a maximum tolerable motor rotational speed of 450 rpm. When the motor rotational speed is 52 rpm, the pumping flow rate reaches its maximum value of 743.3 μL/min. The micropump b has a maximum tolerable motor rotational speed of over 1000 rpm, and the pumping flow rate of the micropump b is still up to 326.7 μL/min at a motor rotational speed of 1000 rpm. When the motor rotational speed is 350 rpm, the pumping flow rate of the micropump b is maximized with a value of 1756.7 μL/min. It may be further seen that, during the continuous pumping of the micropump a, when the motor rotational speed increases to a medium rotational speed (around 200 rpm), its pumping flow rate usually has a sudden decrease. In this case, it can be observed that the magnetic fluid in the annular flow channel 1 starts to disperse. With the increase of the rotational speed, the dispersed magnetic fluid pollutes the whole flow channel, and the pumping flow rate of the micropump gradually decreases until the pumping fails. Therefore, during continuous operation, the micropump b has better pumping stability than the micropump a.

Figure 7:
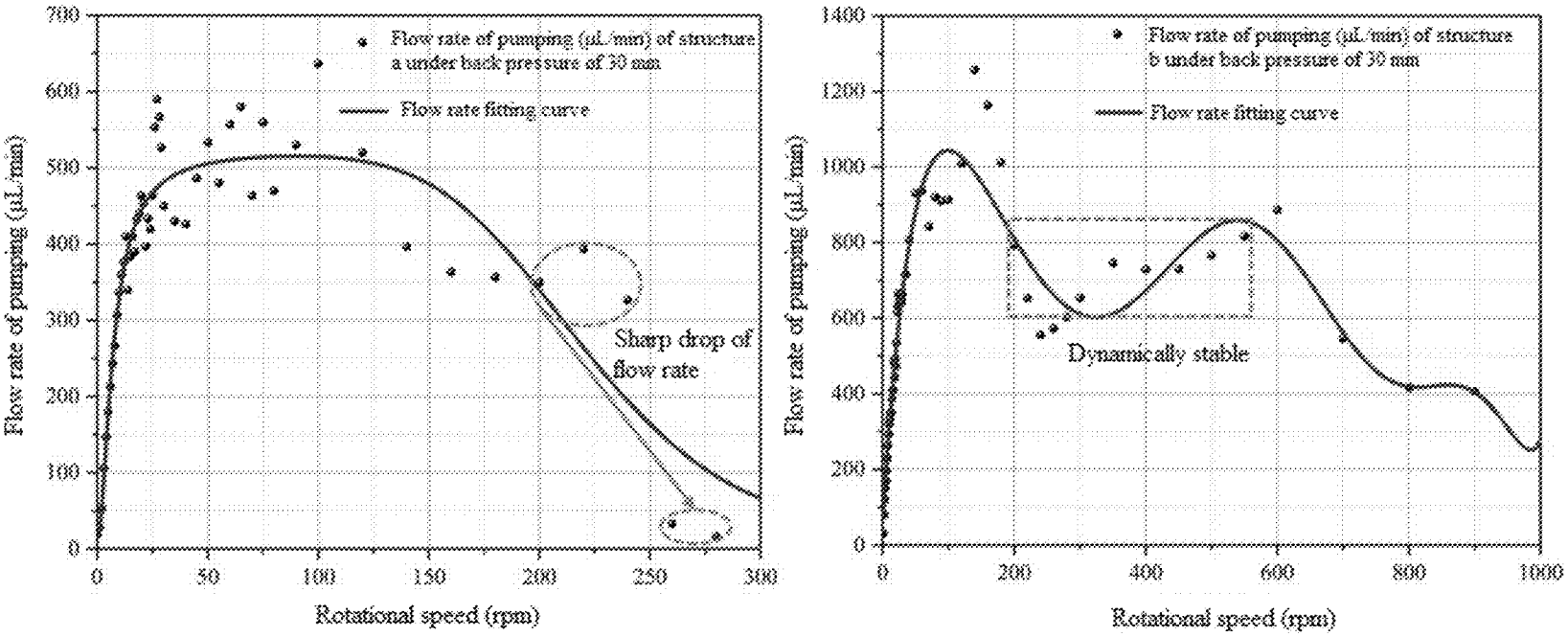
FIG. 7 shows comparison data graphs of the relationship between rotational speed and pumping flow rate for the conventional technology and the present embodiment under a back pressure of 30 mm of water column.
Figure 8:
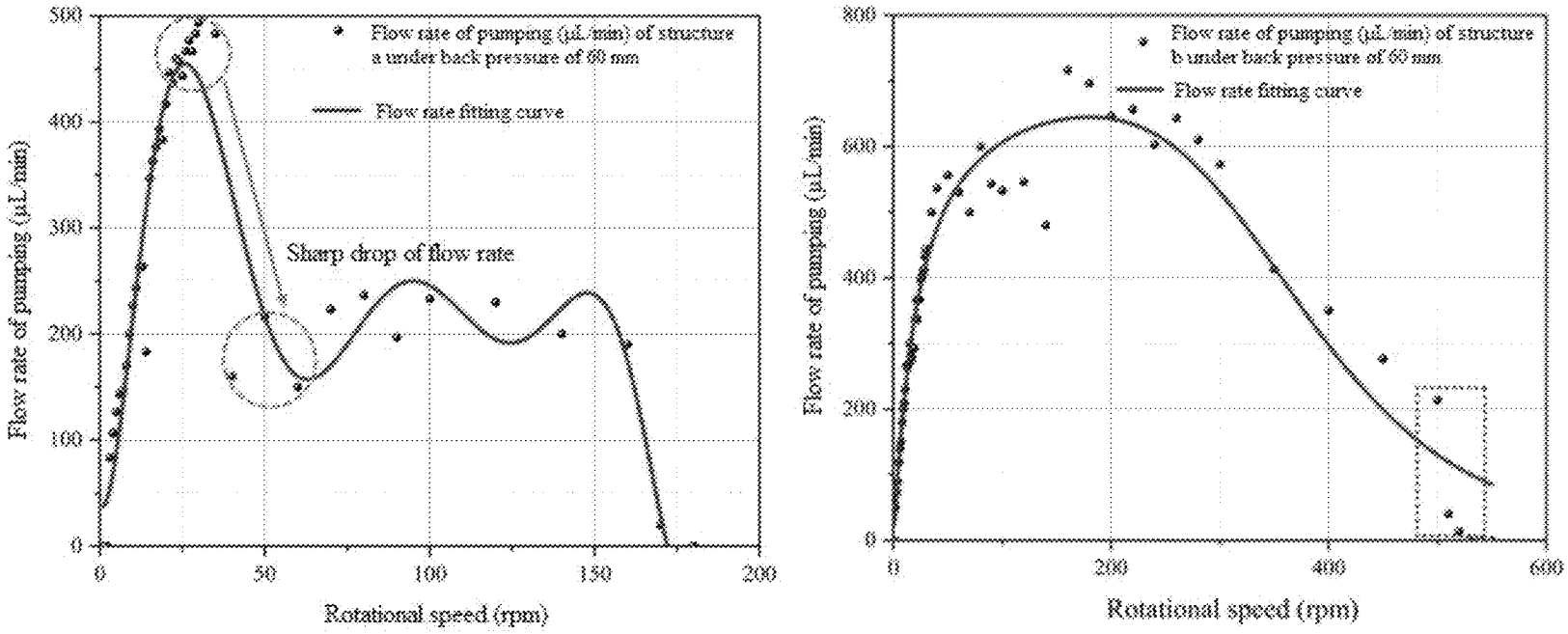
FIG. 8 shows comparison data graphs of the relationship between rotational speed and pumping flow rate for the conventional technology and the present embodiment under a back pressure of 60 mm of water column.

As shown in FIG. 8, the maximum pumping flow rates and the tolerable rotational speeds of the micropumps decrease with the increase of the pumping back pressure. When the pumping back pressure of the micropump a is 60 mm of water column, the maximum pumping flow rate of the micropump a decreases to 493.3 μL/min, and the maximum tolerable motor rotational speed of the micropump a decreases to 180 rpm. When the pumping back pressure of the micropump b is 60 mm of water column, the maximum pumping flow rate of the micropump b decreases to 716.7 L/min, and the maximum tolerable motor rotational speed of the micropump b decreases to 530 rpm. It is worth noting that, as shown in FIG. 7, when the pumping back pressure is 30 mm of water column, the maximum tolerable motor rotational speed of the micropump a decreases to 300 rpm, while the maximum tolerable motor rotational speed of the micropump b is still over 1000 rpm, and the pumping flow rate of the micropump c is still up to 270 μL/min at a motor rotational speed of 1000 rpm. It can be seen from the maximum pumping flow rates and the maximum tolerable motor rotational speeds of the micropumps that, the technical solutions of the present embodiment have a better performance than that of the conventional technology. It can also be seen that, the dispersed magnetic fluid pollutes the entire flow channel, and the pumping flow rate of the micropump will gradually decrease until the pumping fails.

Under a high back pressure (60 mm of water column), the flow rate of the micropump a suffers a sharp drop starting from 50 rpm, while the micropump b can still keep a relativley high pumping flow rate at rotational speeds around 200 rpm or in a higher rotational speed range. Furthermore, when the rotational speed is 200 rpm, the pumping flow rate of the micropump b is increasing or dynamically stable. Additionally, the magnetic fluid of the micropump b gradually disperses at a high rotational speed range under the highest back pressure (60 mm of water column) in the tests. Except for this, the micropump b can stably pump and has a clean internal flow channel under other operating conditions at low or medium rotational speed ranges, which indicates that the present embodiment has better technical effects.

Figure 9:
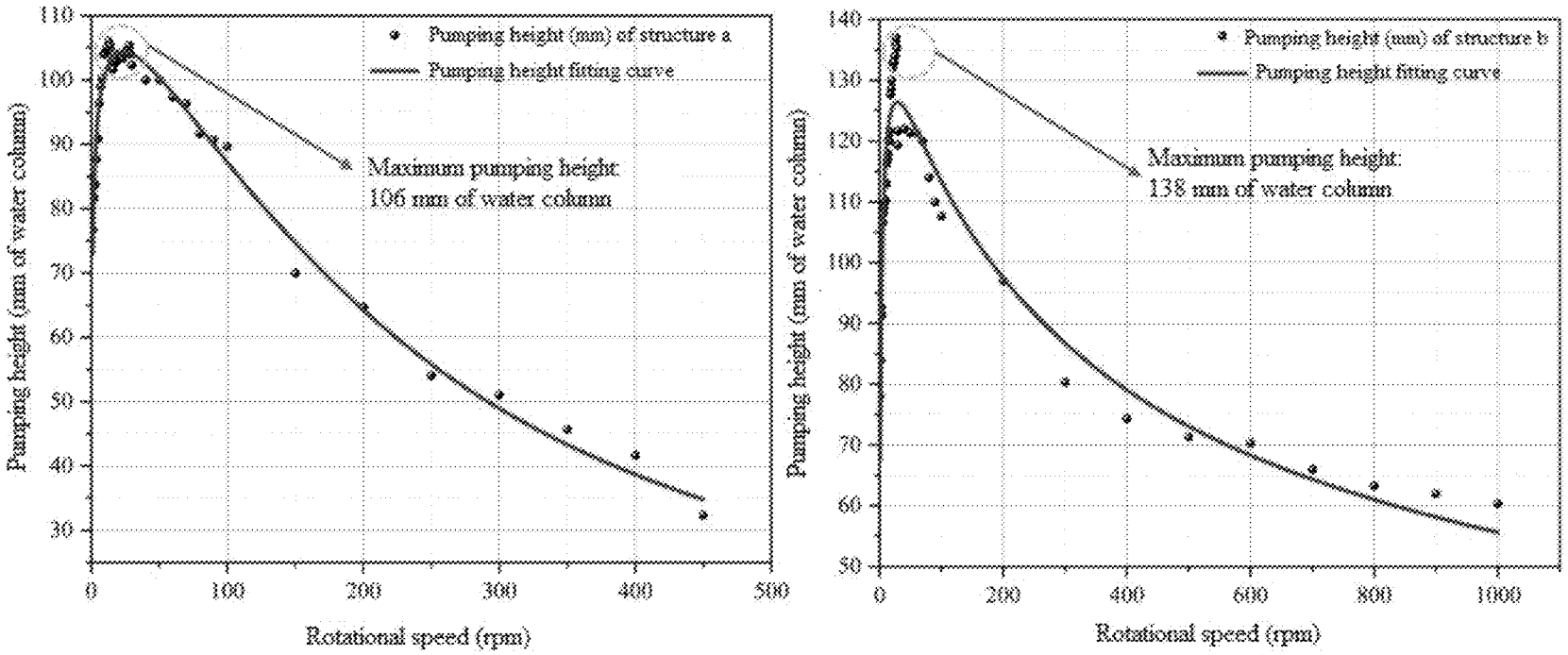
FIG. 9 shows comparison data graphs of pumping heights for the conventional technology and the present embodiment under different rotational speeds.

FIG. 9 shows pumping heights of the micropumps at different rotational speeds. It can be known that, the pumping heights of the micropumps increase with the rotational speed in the low rotational speed range. After reaching the maximum value, the pumping heights of the micropumps will decrease with the increase of the rotational speed. The micropump a has a maximum pumping height of 106 mm of water column within the low rotational speed range, while the micropump b has a maximum pumping height of 138 mm of water column within the low rotational speed range. At rotational speeds of over 300 rpm, the micropump a cannot keep a pumping height of over 50 mm of water column, while the pumping height of the micropump b can be kept within a range from 60 mm to 80 mm of water column.

In summary, the technical solutions of the present embodiment are better than that of the conventional technology in both the maximum pumping height and the pressure resistance at high rotational speeds. That is to say, by providing the first magnet 8 and the second magnet in the present embodiment, the magnetic fluid exhibits a higher response speed to the magnetic field, and the magnetic field holds enhanced magnetization capability on the magnetic fluid. In this way, the pushing force applied on the magnetic fluid is increased, thereby solving the problem of the small driving force of the conventional ferromagnetic fluid micropump. Furthermore, on the basis of this, the magnetic field gradient in the annular flow channel 1 is enhanced, and the effective magnetic field interference zone is expanded, so that the magnetic fluid has better magnetization capability and self-sealing capability in the coupling superposed magnetic field, thereby solving the technical problem of low self-sealing capability of the conventional magnetic fluid micropump. Further, according to the present application, there is a higher coupling magnetic force between the magnetic fluid in the annular flow channel and the driving magnetic assembly 3, so that the magnetic fluid can overcome higher flow resistance to achieve a higher pumping speed, thereby extending the range of the pumping flow rate. As such, it is possible to solve the problem of a narrow range of the pumping flow rate of the conventional magnetic fluid micropump. Based on this, according to the present embodiment, with the arrangements of the first magnet 8 and the second magnet 9, and the arrangements of the inlet tube 5 and the outlet tube 6, the backflow can be effectively suppressed, and the outlet speed pulsation can be effectively reduced, thereby solving the problem of large speed pulsation at the inlet and outlet of the conventional magnetic fluid micropump.

The above embodiments are merely preferred embodiments of the present application. It should be noted that, the above preferred embodiments may not be construed as limitations to the present application. The protection scope of the present application should be defined by the claims. For those skilled in the art, a few of improvements and modifications may be made without departing from the spirit and scope of the present application, and these improvements and modifications are also deemed to fall into the protection scope of the present application.

The invention claimed is:

1. A magnetic fluid micropump, comprising:

an annular flow channel in which a magnetic fluid is provided;

a fixed magnetic assembly, which is arranged outside the annular flow channel in a stationary manner so that a part of the magnetic fluid is attracted and fixated in the annular flow channel to form a magnetic fluid valve, wherein an inlet tube and an outlet tube, which are in communication with the annular flow channel, are respectively provided on both sides of the fixed magnetic assembly along a path of the annular flow channel; and a driving magnetic assembly, which is arranged outside the annular flow channel and is configured to move along the path of the annular flow channel so that another part of the magnetic fluid moves along the annular flow channel to form a magnetic fluid piston, wherein the driving magnetic assembly comprises a first magnet and a second magnet that are respectively located on both sides of a plane in which the annular flow channel is located, wherein when the magnetic fluid piston and the magnetic fluid valve do not merge with each other, the magnetic fluid valve partially blocks the inlet tube and/or the outlet tube; and when the magnetic fluid piston and the magnetic fluid valve merge with each other, the magnetic fluid blocks the inlet tube and/or the outlet tube, wherein magnetic poles of the first magnet are oriented in a same direction as magnetic poles of the second magnet, wherein a direction of magnetic poles of the driving magnetic assembly is perpendicular to a plane of motion of the magnetic fluid piston, and is perpendicular to a direction of magnetic poles of the fixed magnetic assembly.

2. The magnetic fluid micropump according to claim 1, wherein the first magnet and the second magnet are arranged eccentrically on a moving path of the magnetic fluid piston.

3. The magnetic fluid micropump according to claim 2, wherein an eccentricity angle between the first magnet and the second magnet ranges from 1° to 9°.

4. The magnetic fluid micropump according to claim 1, wherein each of the inlet tube and the outlet tube expands along a direction from an inside to an outside of the annular flow channel.

5. The magnetic fluid micropump according to claim 1, wherein during a movement of the magnetic fluid piston along the annular flow channel, an outer edge of the magnetic fluid valve, which partially blocks the inlet tube and the outlet tube, is of an arc shape.

6. The magnetic fluid micropump according to claim 1, wherein each of the inlet tube and the outlet tube extends outwards along a radial direction of the annular flow channel, and the fixed magnetic assembly is arranged on an outer side of the annular flow channel along the radial direction.

7. The magnetic fluid micropump according to claim 1, wherein a length of a first arc of the annular flow channel, where the magnetic fluid valve is attracted onto, is smaller than a length of a second arc of the annular flow channel where the magnetic fluid piston moves.

8. The magnetic fluid micropump according to claim 4, wherein during a movement of the magnetic fluid piston along the annular flow channel, an outer edge of the magnetic fluid valve, which partially blocks the inlet tube and the outlet tube, is of an arc shape.

* * * * *